US007677254B2

(12) United States Patent
Reddy et al.

(10) Patent No.: US 7,677,254 B2
(45) Date of Patent: Mar. 16, 2010

(54) REDUCTION OF CARBON MONOXIDE AND NITRIC OXIDE IN SMOKING ARTICLES USING IRON OXYNITRIDE

(75) Inventors: Budda V. Reddy, Glen Allen, VA (US); Firooz Rasouli, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 1052 days.

(21) Appl. No.: 10/972,208

(22) Filed: Oct. 25, 2004

(65) Prior Publication Data

US 2005/0109356 A1 May 26, 2005

Related U.S. Application Data

(60) Provisional application No. 60/514,530, filed on Oct. 27, 2003.

(51) Int. Cl.
*A24B 15/00* (2006.01)

(52) U.S. Cl. ..... 131/334; 131/331; 502/200; 502/431

(58) Field of Classification Search ..... None
See application file for complete search history.

(56) References Cited

U.S. PATENT DOCUMENTS

| | | | | |
|---|---|---|---|---|
| 3,720,214 | A | | 3/1973 | Norman et al. |
| 3,807,416 | A | | 4/1974 | Hodge et al. |
| 3,931,824 | A | | 1/1976 | Miano et al. |
| 4,108,151 | A | | 8/1978 | Martin et al. |
| 4,109,663 | A | | 8/1978 | Maeda et al. |
| 4,119,104 | A | | 10/1978 | Roth |
| 4,182,348 | A | | 1/1980 | Seehofer et al. |
| 4,193,412 | A | | 3/1980 | Heim et al. |
| 4,195,645 | A | | 4/1980 | Bradley, Jr. et al. |
| 4,197,861 | A | | 4/1980 | Keith |
| 4,235,189 | A | * | 11/1980 | Severin ..... 118/119 |
| 4,421,862 | A | | 12/1983 | Bradley |
| 4,450,847 | A | | 5/1984 | Owens |
| 4,453,553 | A | | 6/1984 | Cohn |

(Continued)

FOREIGN PATENT DOCUMENTS

DE 10048764 A1 4/2002

(Continued)

OTHER PUBLICATIONS

The Journal of Chemical Physics, vol. 52, No. 9, May 1, 1970, pp. 4733-4748.

(Continued)

*Primary Examiner*—Philip C Tucker
*Assistant Examiner*—Michael J Felton
(74) *Attorney, Agent, or Firm*—Buchanan Ingersoll & Rooney PC

(57) ABSTRACT

Smoking article components, cigarettes, methods for making cigarettes and methods for smoking cigarettes are provided that use nitrided transition metal oxide nanoscale particles and/or nitrided transition metal oxide clusters capable of catalyzing and/or oxidizing carbon monoxide to carbon dioxide and/or adsorbing carbon monoxide and catalyzing and/or reducing nitric oxide to nitrogen and/or adsorbing nitric oxide. Cut filler compositions, cigarette paper and cigarette filter material can comprise nitrided transition metal oxide nanoscale particles and/or nitrided transition metal oxide clusters.

15 Claims, 2 Drawing Sheets

U.S. PATENT DOCUMENTS

| | | | | | |
|---|---|---|---|---|---|
| 4,463,030 | A | | 7/1984 | Deffeyes et al. | |
| 4,489,739 | A | | 12/1984 | Mattina, Jr. et al. | |
| 4,698,324 | A | * | 10/1987 | Haruta et al. | 502/243 |
| 4,744,374 | A | | 5/1988 | Deffeves et al. | |
| 4,788,308 | A | | 11/1988 | Siedle | |
| 5,101,839 | A | | 4/1992 | Jakob et al. | |
| 5,105,836 | A | | 4/1992 | Gentry et al. | |
| 5,129,408 | A | | 7/1992 | Jakob et al. | |
| 5,188,130 | A | | 2/1993 | Hajaligol et al. | |
| 5,188,908 | A | | 2/1993 | Nishiyama | |
| 5,211,684 | A | | 5/1993 | Shannon et al. | |
| 5,258,340 | A | * | 11/1993 | Augustine et al. | 502/60 |
| 5,284,166 | A | | 2/1994 | Cartwright et al. | |
| 5,306,683 | A | | 4/1994 | Maroni et al. | |
| 5,322,072 | A | | 6/1994 | Harrison et al. | |
| 5,322,075 | A | | 6/1994 | Deevi et al. | |
| 5,386,838 | A | | 2/1995 | Quincy, III et al. | |
| 5,444,173 | A | | 8/1995 | Oyama et al. | |
| 5,500,198 | A | | 3/1996 | Liu et al. | |
| 5,591,368 | A | | 1/1997 | Fleischhauer et al. | |
| 5,598,868 | A | | 2/1997 | Jakob et al. | |
| 5,671,758 | A | | 9/1997 | Rongved | |
| 5,728,462 | A | | 3/1998 | Arino et al. | |
| 5,759,949 | A | | 6/1998 | Grigorova et al. | |
| 5,925,590 | A | | 7/1999 | White et al. | |
| 5,934,289 | A | | 8/1999 | Watkins et al. | |
| 6,053,176 | A | | 4/2000 | Adams et al. | |
| 6,095,152 | A | | 8/2000 | Beven et al. | |
| 6,138,684 | A | | 10/2000 | Yamazaki et al. | |
| 6,286,516 | B1 | | 9/2001 | Bowen et al. | |
| 6,297,185 | B1 | | 10/2001 | Thompson et al. | |
| 6,371,127 | B1 | | 4/2002 | Snider et al. | |
| 6,769,437 | B2 | | 8/2004 | Hajaligol et al. | |
| 6,782,892 | B2 | | 8/2004 | Li et al. | |
| 6,857,431 | B2 | | 2/2005 | Deevi et al. | |
| 7,004,993 | B2 | | 2/2006 | Pithawalla et al. | |
| 7,152,609 | B2 | | 12/2006 | Li et al. | |
| 7,165,553 | B2 | | 1/2007 | Luan et al. | |
| 7,168,431 | B2 | | 1/2007 | Li et al. | |
| 7,228,862 | B2 | | 6/2007 | Hajaligol et al. | |
| 7,243,658 | B2 | | 7/2007 | Deevi et al. | |
| 2002/0002979 | A1 | | 1/2002 | Bowen et al. | |
| 2002/0062834 | A1 | | 5/2002 | Snaidr et al. | |
| 2002/0114746 | A1 | | 8/2002 | Roark et al. | |
| 2003/0037792 | A1 | | 2/2003 | Snaidr et al. | |
| 2003/0131859 | A1 | | 7/2003 | Li et al. | |
| 2003/0216252 | A1 | * | 11/2003 | Gole | 502/200 |

FOREIGN PATENT DOCUMENTS

| | | | |
|---|---|---|---|
| WO | WO 87/06104 | A1 | 10/1987 |
| WO | WO 93/07303 | A1 | 4/1993 |
| WO | WO 98/51401 | A1 | 11/1998 |
| WO | WO 99/16546 | A1 | 4/1999 |
| WO | WO 99/21652 | A3 | 5/1999 |
| WO | WO 99/25652 | A1 | 5/1999 |
| WO | WO 00/09259 | A3 | 2/2000 |
| WO | WO 00/40104 | A1 | 7/2000 |
| WO | WO 02/24005 | A2 | 3/2002 |
| WO | 03/086115 | A1 | 10/2003 |

OTHER PUBLICATIONS

Rosen, Journal of Molecular Graphics & Modeling, vol. 19, pp. 236-243, 2001.

Advances in Quantum Chemistry, vol. 30, 1998.

Cox et al., Physical Review Letters, vol. 71, No. 6, pp. 923-926, 1993.

Reddy et al., Physical Review Letters, vol. 70, No. 21, pp. 3323-3326, 1993.

Commonly Owned Applications in Connection With U.S. Appl. No. 10/972,208 U.S. Appl. No. 10/460,617, Preparation of Intermetallics by Metallo-Organic Decomposition, filed Jun. 13, 2003.

U.S. Appl. No. 10/460,631, Catalyst to Reduce Carbon Monoxide in the Mainstream Smoke of a Cigarette, filed Jun. 13, 2003.

U.S. Appl. No. 10/460,302, Oxidant/Catalyst Nanoparticles to Reduce Tobacco Smoke Constituents Such as Carbon Monoxide, filed Jun. 13, 2003.

U.S. Appl. No. 10/972,205, Formation and Deposition of Sputtered Nanoscale Particles in Cigarette Manufacture, filed Oct. 25, 2004.

U.S. Appl. No. 10/972,209, In Situ Synthesis of Composite Nanoscale Particles, filed Oct. 25, 2004.

U.S. Appl. No. 10/972,201, Tobacco Cut Filler Including Metal Oxide Supported Particles, filed Oct. 25, 2004.

U.S. Appl. No. 10/972,202, Preparation of Mixed Metal Oxide Catalysts From Nanoscale Particles, filed Oct. 25, 2004.

U.S. Appl. No. 10/972,203, Cigarettes and Cigarette Components Containing Nanostructured Fibril Materials, filed Oct. 25, 2004.

U.S. Appl. No. 10/866,181, Cigarette Wrapper With Catalytic Filler and Methods of Making Same, filed Jun. 14, 2004.

U.S. Appl. No. 10/870,449, Shredded Paper With Catalytic Filler in Tobacco Cut Filler and Methods of Making Same, filed Jun. 14, 2004.

U.S. Appl. No. 10/972,206, Reduction of Carbon Monoxide in Smoking Articles Using Transition Metal Oxide Clusters, filed Oct. 25, 2004.

U.S. Appl. No. 10/868,015, Silver and Silver Oxide Catalysts for the Oxidation of Carbon Monoxide in Cigarette Smoke, filed Jun. 16, 2004.

U.S. Appl. No. 11/252,773, Palladium-Containing Nanoscale Catalysts, filed Oct. 19, 2005.

U.S. Appl. No. 10/972,207, Use of Oxyhydroxide Compounds in Cigarette Paper for Reducing Carbon, filed Oct. 25, 2004.

U.S. Appl. No. 10/972,295, Cigarette Wrapper With Nanoparticle Spinel Ferrite Catalyst and Methods of Making Same, filed Oct. 25, 2004.

U.S. Appl. No. 10/972,204, In Situ Synthesis of Composite Nanoscale Particles, filed Oct. 25, 2004.

U.S. Appl. No. 11/653,856, Cigarette Components Having Encapsulated Catalyst Particles and Methods of Making and Use Thereof, filed Jan. 17, 2007.

U.S. Appl. No. 11/636,589, Supported Catalysts, filed Dec. 11, 2006.

U.S. Appl. No. 11/729,951, In Situ Formation of Catalytic Cigarette Paper, filed Mar. 30, 2007.

U.S. Appl. No. 11/698,192, Catalysts to Reduce Carbon Monoxide Such as in the Mainstream Smoke of a Cigarette, filed Jan. 26, 2007.

U.S. Appl. No. 10/950,663, Nanocomposite Copper-Ceria Catalysts for Low Temperature or Near-Ambient Temperature Catalysis and Methods for Making Such Catalysts, filed Sep. 28, 2004.

U.S. Appl. No. 11/252,849, Gold-Ceria Catalyst for Oxidation of Carbon Monoxide, filed Oct. 19, 2005.

U.S. Appl. No. 11/452,995, Gold-Ceria Catalyst for Oxidation of Carbon Monoxide, filed Jun. 15, 2006.

U.S. Appl. No. 11/370,843, Method for Forming Activated Copper Oxide Catalysts, filed Mar. 9, 2006.

U.S. Appl. No. 11/371,021, Catalysts for Low Temperature Oxidation of Carbon Monoxide, filed Mar. 9, 2006.

U.S. Appl. No. 11/641,003, Corrugated Catalytic Cigarette Paper and Cigarettes Comprising the Same, filed Dec. 19, 2006.

U.S. Appl. No. 11/077,554, Methods for Forming Transition Metal Oxide Clusters and Smoking Articles Comprising Transition Metal Oxide Clusters, filed Mar. 11, 2005.

U.S. Appl. No. 10/560,396, Cigarette Wrapper With Printed Catalyst, filed Nov. 2, 2006.

International Search Report and the Written Opinion dated Apr. 14, 2005 for PCT/IB2004/003649.

International Preliminary Report on Patentability for PCT/IB2004/003649 dated May 1, 2006.

* cited by examiner

REDUCTION OF CARBON MONOXIDE AND NITRIC OXIDE IN SMOKING ARTICLES USING IRON OXYNITRIDE

This application claims priority under 35 U.S.C. §119 to U.S. Provisional Application No. 60/514,530 entitled REDUCTION OF CARBON MONOXIDE AND NITRIC OXIDE IN SMOKING ARTICLES USING NANOSCALE PARTICLES AND/OR CLUSTERS OF NITRIDED TRANSITION METAL OXIDES, filed Oct. 27, 2003, the entire content of which is hereby incorporated by reference.

BACKGROUND

Smoking articles, such as cigarettes or cigars, produce both mainstream smoke during a puff and sidestream smoke during static burning. Constituents of both mainstream smoke and sidestream smoke are carbon monoxide (CO) and nitric oxide (NO). The reduction of carbon monoxide and nitric oxide in smoke is desirable.

Despite the developments to date, there remains an interest in improved and more efficient methods and compositions for reducing the amount of carbon monoxide in the mainstream smoke of a cigarette during smoking.

SUMMARY

Disclosed is a component of a smoking article comprising nanoscale particles and/or clusters of nitrided transition metal oxides (i.e., oxynitride particles and/or oxynitride clusters), wherein the component is selected from the group consisting of tobacco cut filler, cigarette paper and cigarette filter material. As used herein, "nanoscale oxynitride" refers to nitrided transition metal oxide nanoscale particles and/or nitrided transition metal oxide clusters. Also disclosed is a cigarette comprising a tobacco rod, cigarette paper and an optional filter, wherein at least one of the tobacco rod, cigarette paper and optional filter comprise a nanoscale oxynitride.

The nanoscale oxynitrides can comprise at least one transition metal selected from the group consisting of scandium, titanium, vanadium, chromium, manganese, iron, cobalt, nickel, copper and mixtures thereof. Preferably the nanoscale oxynitrides consist of oxygen, nitrogen and the transition metal. Preferred nitrided transition metal oxide nanoscale particles are $Fe_2O_{3-x}N_x$ and $Fe_3O_{4-x}N_x$ ($x<3$ and $x<4$, respectively), where Fe is iron, O is oxygen and N is nitrogen.

The nanoscale oxynitrides (i.e., particles, clusters or mixtures thereof) are capable of reducing the amount of carbon monoxide and/or nitric oxide in cigarette smoke via catalysis, oxidation and/or reduction. For example, nanoscale oxynitride particles having the general formula $M_2O_{3-x}N_x$ (where M represents at least one transition metal and $x<3$) can oxidize CO and reduce NO in the presence or absence of an external source of oxygen. Nanoscale particles having the general formula $M_3O_{4-x}N_x$ ($x<^4$) can oxidize CO and reduce NO in the presence of an external source of oxygen. Clusters having the general formula $M_xO_yN_z$ ($y>x$; $z<x$) are capable of converting carbon monoxide to carbon dioxide and nitric oxide to nitrogen in the absence of an external source of oxygen by donating oxygen atoms to the carbon monoxide. Clusters having the general formula $M_xO_yN_z$ ($y\leqq x$; $z\leqq y$) are capable of converting carbon monoxide to carbon dioxide and nitric oxide to nitrogen in the presence of an external source of oxygen.

The nanoscale oxynitrides can be incorporated into a smoking article component and/or into a cigarette in an amount effective to reduce the ratio in mainstream smoke of carbon monoxide and/or nitric oxide to total particulate matter by at least about 10%.

The nanoscale particles can have a mean diameter of less than about 500 nm, preferably less than about 100 nm, most preferably less than about 50 nm. The clusters can have a mean diameter of less than about 2 nm or less than about 1 nm, and can comprise fewer than about 2,500 atoms or fewer than about 1,000 atoms. In an embodiment the oxynitride particles and oxynitride clusters are charge neutral.

The nanoscale oxynitrides can be supported on support particles. The support particles can be selected from the group consisting of silica gel beads, activated carbon, molecular sieves, magnesia, alumina, silica, titania, zirconia, iron oxide, cobalt oxide, nickel oxide, copper oxide, yttria optionally doped with zirconium, manganese oxide optionally doped with palladium, ceria and mixtures thereof. The support particles can comprise nanoscale particles. Preferably the nanoscale oxynitrides are combined with support particles to give a loading of nanoscale oxynitrides on the support particles of less than about 10 wt. % of the support. Supported or unsupported nanoscale oxynitrides can be incorporated in and/or on a smoking article component to give a loading of nanoscale oxynitrides of less than about 10 wt. % of the component. A smoking article component comprising supported or unsupported nanoscale oxynitrides can be incorporated in a cigarette to give a loading of nanoscale oxynitrides of less than about 10 wt. % of the cigarette.

Also provided is a method for incorporating nitrided transition metal oxide nanoscale particles and/or nitrided transition metal oxide clusters in and/or on a component of a smoking article comprising (i) supporting the component in a chamber having a target; (ii) bombarding the target with energetic ions to form nitrided transition metal oxide nanoscale particles and/or nitrided transition metal oxide clusters; and (iii) depositing the nitrided transition metal oxide nanoscale particles and/or nitrided transition metal oxide clusters on a surface of the component in order to incorporate the nitrided transition metal oxide nanoscale particles and/or nitrided transition metal oxide clusters in and/or on the component, wherein the component is selected from the group consisting of tobacco cut filler, cigarette paper and cigarette filter material.

Supported nanoscale oxynitrides can be formed by bombarding a target comprising at least first and second transition metal elements. Nanoscale oxynitrides comprising the first metallic element can be formed that are supported on support particles comprising the second metallic element. The supported nanoscale oxynitrides can be collected and incorporated in and/or on a component of a smoking article or the supported nanoscale oxynitrides can be formed and directly incorporated in and/or on a component of a smoking article that is provided within the chamber during the bombardment.

The chamber can comprise a vacuum chamber and the pressure inside the chamber during the bombarding can be greater than about $1\times10^{-4}$ Torr. In an embodiment, the pressure inside the chamber is about atmospheric pressure. During the bombarding of the target the atmosphere in the chamber can comprise an inert gas, an oxidizing gas and/or a nitriding gas. For example, the atmosphere can comprise argon, an oxidizing gas such as oxygen and/or a nitriding gas such as nitrogen or a mixture of nitrogen and hydrogen (e.g., forming gas). In addition to oxygen, suitable oxidizing gases include CO, $CO_2$, NO, $H_2O$ or mixtures thereof. In addition to nitrogen, suitable nitriding gases include $NH_3$.

The component can be supported during the bombardment on a substrate holder having a temperature of from about −196° C. to 100° C. The component can be supported at a distance of from about 2 to 20 cm from the target.

In a preferred embodiment the target is bombarded with a laser to produce the nanoscale oxynitrides. In a further embodiment, the target is subjected to radio frequency sputtering or magnetron sputtering to produce the nanoscale oxynitrides. The nanoscale oxynitrides (i.e., particles and/or clusters) preferably form in the gas phase.

A further preferred embodiment provides a method of making a cigarette, comprising (i) incorporating nanoscale oxynitrides in and/or on a component of a cigarette selected from the group consisting of tobacco cut filler, cigarette paper and cigarette filter material; (ii) providing the tobacco cut filler to a cigarette making machine to form a tobacco column; (iii) placing the cigarette paper around the tobacco column to form a tobacco rod of a cigarette, and (iv) optionally tipping the tobacco rod with a cigarette filter comprising the cigarette filter material.

An additional embodiment relates to a method for incorporating nanoscale oxynitrides in and/or on a component of a smoking article comprising spraying, dusting and/or mixing the nanoscale oxynitrides with the component.

A method of smoking a cigarette is provided comprising lighting the cigarette to form smoke and drawing the smoke through the cigarette, wherein during the smoking of the cigarette, nanoscale oxynitrides convert carbon monoxide to carbon dioxide and/or convert nitric oxide to nitrogen. During the smoking of the cigarette the oxidation state of the nanoscale oxynitrides can continuously change.

DETAILED DESCRIPTION OF PREFERRED EMBODIMENTS

Figure 1A:
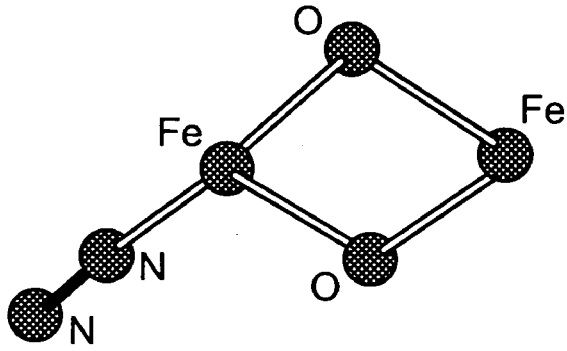
FIG. 1A is an illustration of the ground state geometry of an $Fe_2ON$ cluster.

Smoking article components (e.g., tobacco cut filler, cigarette paper and cigarette filter material), smoking articles (e.g., cigarettes), methods for making cigarettes and methods for smoking cigarettes are provided that use nitrided transition metal oxide nanoscale particles and/or nitrided transition metal oxide clusters (i.e., nanoscale oxynitrides). The nanoscale oxynitrides, which are incorporated in and/or on the smoking article component(s), can adsorb carbon monoxide (CO) and/or convert carbon monoxide to carbon dioxide, and adsorb nitric oxide (NO) and/or convert nitric oxide to nitrogen.

Nitrided transition metal oxide nanoscale particles and clusters can be represented by the general formula $M_xO_yN_z$ ($x>0$; $y>0$; $z>0$) where M represents at least one transition metal selected from the group consisting of Sc, Ti, V, Cr, Mn, Fe, Co, Ni and Cu, and where O is oxygen and N is nitrogen. Nanoscale particles are a class of materials whose distinguishing feature is that their average diameter, particle or other structural domain size is below about 500 nanometers. Nitrided transition metal oxide nanoscale particles can have an average particle size less than about 100 nm, preferably less than about 50 nm, more preferably less than about 10 nm, and most preferably less than about 7 nm. A cluster can be characterized as an assembly of atoms that are bonded together. Nitrided transition metal oxide clusters comprise from four to a few thousand atoms. For example, the clusters can comprise fewer than about 2,500 atoms, e.g., fewer than about 2,000; 1,500; 1,000; 750; 500; 250; 100; 50 or 10 atoms. Nitrided transition metal oxide clusters have an average particle size of less than about 3 nm, e.g., less than about 2.5, 2 or 1.5 nm.

The nanoscale oxynitrides (i.e., oxynitride particles and/or clusters) can comprise one or more different transition metal elements. The metallic elements can comprise the same or different oxidation states. Thus, mixed nanoscale oxynitrides can comprise different transition metals (e.g., a mixture of iron oxynitride and copper oxynitride) or the same transition metal in different valence states (e.g., particles or clusters comprising iron having different oxidation states such as $Fe^{2+}$ and $Fe^{3+}$).

Without wishing to be bound by theory, the nanoscale oxynitrides can enhance the conversion of carbon monoxide to carbon dioxide as well as the conversion of nitric oxide to nitrogen on account of their high surface area to volume ratio, flexible geometric structure and multiplicity of oxidation states. Transition metal oxynitride clusters can affect charge distribution and the breaking of localized bonds in carbon monoxide, nitric oxide and oxygen.

Nanoscale oxynitrides can facilitate the conversion of carbon monoxide to carbon dioxide and/or the conversion of nitric oxide to nitrogen in either the absence or presence of an external source of oxygen. An external source of oxygen is oxygen from the gas phase. An internal source of oxygen is oxygen from the solid state, i.e., from the oxynitride lattice. For instance, nanoscale oxynitrides of the type $M_xO_yN_z$ ($y>x$; $x>z$) can convert carbon monoxide to carbon dioxide in an oxygen-poor environment by donating oxygen atoms from the particle or cluster lattice to the carbon monoxide. The oxynitride is an oxidant (i.e., the oxynitride is itself reduced) when the oxynitride donates a lattice oxygen from the oxynitride to a carbon monoxide molecule. Nanoscale oxynitrides of the type $M_xO_yN_z$ ($y>x$; $x>z$) can also convert carbon monoxide to carbon dioxide and nitric oxide to nitrogen in the presence of an external source of oxygen. In a further example, nanoscale oxynitrides of the type $M_xO_yN_z$ ($y\leqq x$; $y\geqq z$) can convert carbon monoxide to carbon dioxide and/or nitric oxide to nitrogen in the presence of an external source of oxygen. In the presence of oxygen it is believed that the conversion of carbon monoxide proceeds via CO adsorption and subsequent oxidation.

A nanoscale oxynitride having the formula $M_xO_yN_z$ ($y>x$) is referred to as an oxygen-rich or Type A oxynitride. Type A oxynitride clusters can undergo a geometric distortion upon initial adsorption of a CO molecule. This distortion can occur in the presence or absence of an external source of oxygen. The distortion involves the breaking of a metal-oxygen bond via the adsorption of a CO molecule. The metal-oxygen bond scission creates an unsaturated oxygen atom in a favorable path of access for a subsequent CO molecule. The subsequent CO molecule can be oxidized by the unsaturated oxygen atom. A Type A cluster can oxidize CO to $CO_2$ by donating a lattice oxygen from the cluster. Thus, in the reaction between a Type A cluster and CO the Type A cluster can be reduced to form a Type B cluster.

A nanoscale oxynitride having the formula $M_xO_yN_z$ ($y\leqq x$) is referred to as an oxygen-poor or Type B oxynitride. An example of a Type B cluster in the iron oxide system is $Fe_2ON$. A schematic illustration of the ground state geometry of an $Fe_2ON$ cluster is shown in FIG. 1A. The ground state geometry of a $Fe_2ON$ cluster is a distorted rhombus. In the presence of an external source of oxygen, Type B clusters such as $Fe_2ON$ can adsorb CO molecules and, via the formation of a $CO_3$ intermediate, desorb a $CO_2$ molecule. The reaction between a Type B cluster and CO can oxidize the Type B cluster to form a Type A cluster. The initial CO adsorption by a Type A cluster can form active catalytic sites within the cluster that can be continuously regenerated to sustain catalytic conversion and/or oxidation of carbon monoxide. Furthermore, in the absence of an external source of oxygen a Type B clusters can adsorb a CO molecule.

While not wishing to be bound by theory, it is believed that oxygen atom and electron transfer processes are involved in the oxidation reactions and that the nanoscale oxynitride clusters can provide suitable surface sites for the chemisorption of carbon monoxide and nitric oxide and may activate oxygen and/or facilitate atomic and electronic transfers. Thus, nanoscale oxynitride clusters can serve as an oxygen activation and exchange medium during the catalysis and/or oxidation of carbon monoxide to carbon dioxide as well as the catalysis and/or reduction of nitric oxide to nitrogen.

Figure 1B:
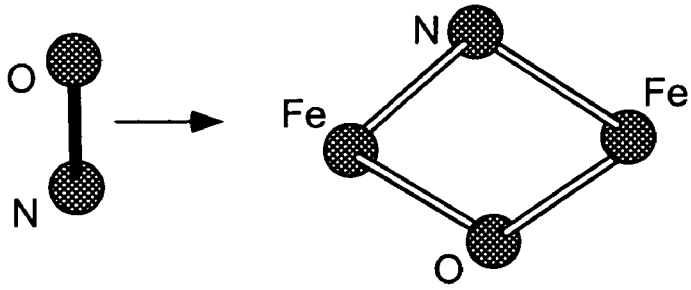
FIG. 1B is an illustration of the geometry of an $Fe_2ON$ cluster prior to interaction with a NO molecule.
Figure 1C:
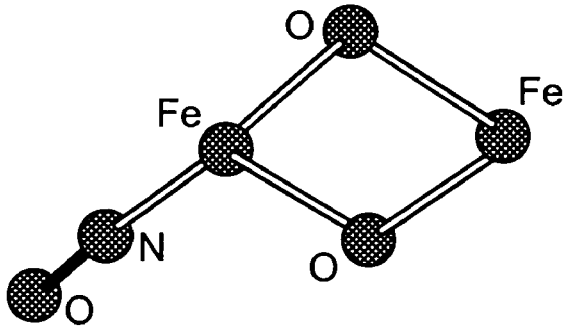
FIG. 1C is an illustration of the geometry of an $Fe_2O_2$—$N_2$ cluster.

A Type B cluster such as $Fe_2ON$ can adsorb a NO molecule and, via the oxidation of the Type B cluster, convert NO to $N_2$. The approaching NO molecule is believed to selectively bond with the nitrogen atom in the $Fe_2ON$ cluster, which because of the strong N—N bond, can cleave the N—O molecular bond and release an atomic oxygen that oxidizes the host cluster, e.g., converts $Fe_2ON$ to $Fe_2O_2$. By cleaving the N—O molecular bond, a nitrogen molecule can be formed that is believed to be adsorbed at an Fe site with a relatively low binding energy (i.e., less energy than a CO or NO molecule bound to the same Fe site). Thus, the facile desorption of the $N_2$ molecule can produce a transition metal oxide cluster (e.g., $Fe_2O_2$) that can in turn oxidize CO to $CO_2$. The configuration of an $Fe_2ON$ cluster before and after interaction with NO is shown in FIGS. 1B and 1C, respectively. In contrast, the initial interaction between a $Fe_2O_2$ cluster (comparative) and NO is believed to proceed via the adsorption of the NO at an Fe site.

The process of NO adsorption and subsequent reduction by a nanoscale oxynitride cluster is independent of CO oxidation. Indeed, the interaction of NO with a nanoscale oxynitride assists CO oxidation via oxygen donation (from the NO molecule) to the nanoscale oxynitride. Thus, by incorporating nanoscale oxynitrides in a smoking article, it is possible to simultaneously oxidize CO to $CO_2$ and reduce NO to $N_2$.

Nanoscale oxynitrides such as iron oxynitride nanoscale particles and iron oxynitride clusters can be incorporated into smoking articles such as cigarettes in order to reduce the concentration of carbon dioxide and/or nitric oxide in the mainstream smoke of the smoking article. Aspects of incorporating nanoscale oxynitrides into smoking article components are described below.

"Smoking" of a cigarette means the heating or combustion of the cigarette to form smoke, which can be drawn through the cigarette. Generally, smoking of a cigarette involves lighting one end of the cigarette and, while the tobacco contained therein undergoes a combustion reaction, drawing the cigarette smoke through the mouth end of the cigarette. The cigarette may also be smoked by other means. For example, the cigarette may be smoked by heating the cigarette and/or heating using electrical heater means, as described in commonly-assigned U.S. Pat. No. 6,053,176; 5,934,289; 5,591,368 or 5,322,075.

The term "mainstream" smoke refers to the mixture of gases passing down the tobacco rod and issuing through the filter end, i.e., the amount of smoke issuing or drawn from the mouth end of a cigarette during smoking of the cigarette. The mainstream smoke contains smoke that is drawn in through both the lighted region, as well as through the cigarette paper wrapper.

In addition to the constituents in the tobacco, the temperature and the oxygen concentration are factors affecting the formation and reaction of carbon monoxide, nitric oxide, carbon dioxide and nitrogen. The total amount of carbon monoxide, for example, formed during smoking comes from a combination of three main sources: thermal decomposition (about 30%), combustion (about 36%) and reduction of carbon dioxide with carbonized tobacco (at least 23%). Formation of carbon monoxide from thermal decomposition, which is largely controlled by chemical kinetics, starts at a temperature of about 180° C. and finishes at about 1050° C. Formation of carbon monoxide and carbon dioxide during combustion is controlled largely by the diffusion of oxygen to the surface ($k_a$) and via a surface reaction ($k_b$). At 250° C., $k_a$ and $k_b$, are about the same. At about 400° C., the reaction becomes diffusion controlled. Finally, the reduction of carbon dioxide with carbonized tobacco or charcoal occurs at temperatures around 390° C. and above.

While not wishing to be bound by theory, it is believed that the nanoscale oxynitrides can target the various reactions that occur in different regions of the cigarette during smoking. During smoking there are three distinct regions in a cigarette: the combustion zone, the pyrolysis/distillation zone, and the condensation/filtration zone.

First, the combustion zone is the burning zone of the cigarette produced during smoking of the cigarette, usually at the lighted end of the cigarette. The temperature in the combustion zone ranges from about 700° C. to about 950° C., and the heating rate can be as high as 500° C./second. Because oxygen is being consumed in the combustion of tobacco to produce carbon monoxide, carbon dioxide, nitric oxide, water vapor, and various organic compounds, the concentration of oxygen is low in the combustion zone. The low oxygen concentrations coupled with the high temperature leads to the reduction of carbon dioxide to carbon monoxide by the carbonized tobacco. In this region, the nanoscale oxynitrides can convert carbon monoxide to carbon dioxide via both catalysis and oxidation mechanisms, and the nanoscale oxynitrides can convert nitric oxide to nitrogen via both catalysis and reduction mechanisms. The combustion zone is highly exothermic and the heat generated is carried to the pyrolysis/distillation zone.

The pyrolysis zone is the region behind the combustion zone, where the temperatures range from about 200° C. to about 600° C. The pyrolysis zone is where most of the carbon monoxide is produced. The major reaction is the pyrolysis (i.e., thermal degradation) of the tobacco that produces carbon monoxide, carbon dioxide, nitric oxide, smoke components, charcoal and/or carbon using the heat generated in the combustion zone. There is some oxygen present in this region, and thus the nanoscale oxynitrides may act as a catalyst and/or oxidant for the conversion of carbon monoxide to carbon dioxide and/or as a catalyst and/or reducing agent for the conversion of nitric oxide to nitrogen. The catalytic reactions begin at 150° C. and reach maximum activity around 300° C. In the pyrolysis zone the nanoscale oxynitrides may also adsorb carbon monoxide and nitric oxide.

Third, there is the condensation/filtration zone, where the temperature ranges from ambient to about 150° C. The major process in this zone is the condensation/filtration of the smoke components. Some amount of carbon monoxide and carbon dioxide diffuse out of the cigarette and some oxygen diffuses into the cigarette. The partial pressure of oxygen in the condensation/filtration zone does not generally recover to the atmospheric level. In the condensation/filtration zone carbon monoxide and nitric oxide can be converted to carbon dioxide and nitrogen respectively via interaction with the nanoscale oxynitrides.

The nanoscale oxynitrides may function as an adsorbent, catalyst, oxidant and/or reducing agent depending upon the reaction conditions. Preferably, the oxynitrides are capable of adsorbing and catalyzing the conversion of carbon monoxide to carbon dioxide and nitric oxide to nitrogen simultaneously.

A catalyst is capable of affecting the rate of a chemical reaction, e.g., increasing the rate of oxidation of carbon monoxide to carbon dioxide without participating as a reactant or product of the reaction. An oxidant is capable of oxidizing a reactant, e.g., by donating oxygen to the reactant, such that the oxidant itself is reduced. A reducing agent is capable of reducing a reactant, e.g., by receiving oxygen from the reactant, such that the reducing agent itself is oxidized. An adsorbent is a substance that causes passing molecules or ions to adhere to its surface.

Nanoscale oxynitrides, and optionally mixtures of nanoscale oxynitrides comprising different transition metals, can adsorb CO and NO and reduce the concentration of both CO and NO in the same zone of a cigarette or in different zones of a cigarette. For example, $Fe_2ON$ clusters can be incorporated throughout a cigarette rod and/or throughout cigarette paper. As a further example, a mixture of different nanoscale oxynitrides (e.g., $Fe_2ON$ clusters and larger $Fe_2ON$ nanoscale particles) can be incorporated throughout a cigarette rod and/or throughout cigarette paper. The $Fe_2ON$ clusters can reduce NO to $N_2$ by abstracting an oxygen atom from NO and forming $Fe_2O_2$ clusters. The resulting $Fe_2O_2$ clusters can oxidize CO in the presence of an external source of oxygen. As noted above, the NO and CO reactions involving nanoscale oxynitrides are independent. Thus, the conversion reactions can be carried out simultaneously. Throughout the conversion process the oxidation state of clusters participating in the conversion reactions can change continuously (e.g., a nanoscale particle or cluster can first be reduced, then oxidized, then reduced, etc., or a nanoscale particle or cluster can first be oxidized, then reduced, then oxidized, etc.).

In a preferred embodiment, the nanoscale oxynitrides are provided in and/or on a support and supported nanoscale oxynitrides are incorporated in and/or on a smoking article component. The support may include substantially any material that does not destroy the adsorptive, catalytic, oxidizing and/or reducing properties of the nanoscale oxynitrides.

The support can comprise inorganic oxide particles such as silica gel beads, molecular sieves, magnesia, alumina, silica, titania, zirconia, iron oxide, cobalt oxide, nickel oxide, copper oxide, yttria optionally doped with zirconium, manganese oxide optionally doped with palladium, ceria and mixtures thereof. The support, if used, is not particularly restricted and such conventional inorganic oxide supports such as silica and alumina, and a carbon support can be used without limitation. The support can comprise activated carbon particles, such as PICA carbon (PICA Carbon, Levallois, France). The support particles are preferably characterized by a BET surface area greater than about 20 $m^2/g$, e.g., 50 $m^2/g$ to 2,500 $m^2/g$, optionally with pores having a pore size greater than about 3 Angstroms, e.g., 10 Angstroms to 10 microns.

The support can comprise porous or non-porous particles. Pores with diameters less than 20 nm are commonly known as micropores; in activated carbon these micropores generally contain the largest portion of the carbon's surface area. Pores with diameters between 20 and 500 nm are known as mesopores, and pores with diameters greater than 500 nm are defined as macropores. The nanoscale oxynitrides can be supported on an external surface of the support or within the channels and pores of a porous support such as porous ceramic material. For example, the support can comprise porous granules and beads, which may or may not comprise interconnected passages that extend from one surface of the support to another.

A support can act as a separator, which can inhibit diffusion, agglomeration or sintering together of the nanoscale oxynitrides before or during combustion of the cut filler. Because a support can minimize nanoscale particle and cluster sintering, it can minimize the loss of active surface area of the nanoscale oxynitrides. The nanoscale oxynitrides can be chemically or physically bonded to the support.

Exemplary classes of porous ceramic materials that can be used as a support include molecular sieves such as natural or synthetic zeolites, microporous aluminum phosphates, silicoaluminum phosphates, silicoferrates, silicoborates, silicotitanates, magnesium aluminate spinels, zinc aluminates and mixtures thereof.

An example of a porous support is silica gel beads. Fuji-Silysia (Nakamura-ka, Japan) markets silica gel beads that range in size from about 5 to 30 microns and have a range of average pore diameters of from about 2.5 nm to 100 nm. The surface area of the silica gel beads ranges from about 30-800 $m^2/g$.

The support can comprise nanoscale particles. Nanoscale support particles can have an average particle size less than about 500 nm (e.g., less than 100 nm, preferably less than about 50 nm, more preferably less than about 10 nm, and most preferably less than about 7 nm). The support may comprise catalytically active particles.

An example of a non-porous support is nanoscale iron oxide particles. For instance, MACH I, Inc., King of Prussia, Pa. sells $Fe_2O_3$ nanoscale particles under the trade names NANOCAT® Superfine Iron Oxide (SFIO) and NANOCAT® Magnetic Iron Oxide. The NANOCAT® Superfine Iron Oxide is amorphous ferric oxide in the form of a free flowing powder, with a particle size of about 3 nm, a specific surface area of about 250 $m^2/g$, and a bulk density of about 0.05 g/ml. The NANOCAT® Superfine Iron Oxide is synthesized by a vapor-phase process, which renders it free of impurities, and is suitable for use in food, drugs, and cosmetics. The NANOCAT® Magnetic Iron Oxide is a free flowing powder with a particle size of about 25 nm and a surface area of about 40 $m^2/g$. NANOCAT® Superfine Iron Oxide (SFIO) and NANOCAT® Magnetic Iron Oxide are preferred support particles for the transition metal oxide clusters.

Nanoscale oxynitrides can be supported directly or indirectly by one or more different types of supports. For example, nanoscale oxynitrides can be supported on nanoscale particles that can in turn be supported on larger support particles such as molecular sieves. The molecular sieves can act as a separator, which can inhibit agglomeration or sintering together of the nanoscale particles (e.g., nanoscale oxynitrides and/or nanoscale support particles) before or during combustion of the cut filler. Sintering of the nanoscale particles may elongate the combustion zone during combustion of the tobacco cut filler, which can result in excess carbon monoxide or nitric oxide production.

Preferably, the selection of appropriate nanoscale oxynitrides and optional support material(s) will take into account such factors as stability and preservation of activity during storage conditions, low cost and abundance of supply.

Nanoscale oxynitrides may be incorporated in and/or on a support by various methods such impregnation or physical admixture. For example, the nanoscale oxynitrides may be dispersed in a liquid, and a support may be mixed with the liquid having the dispersed nanoscale oxynitrides. Nanoscale oxynitrides dispersed in a liquid can be combined with a support using techniques such as spraying or dipping. After combining the support with the dispersed oxynitrides, the liquid can be removed such as by evaporation so that the particles and/or clusters remain on the support. The liquid may be substantially removed by heating the nanoscale oxynitride-support mixture at a temperature higher than the boiling point of the liquid or by reducing the pressure of the atmosphere surrounding the nanoscale oxynitride-support mixture.

Substantially dry nanoscale oxynitrides can be admixed with a support by dusting or via physical admixture. The nanoscale oxynitrides can be chemically or physically bonded to an exposed surface of a support (e.g., an external surface of the support and/or a surface within a pore or cavity of the support).

A preferred support for nanoscale oxynitrides is iron oxide particles. Iron oxide particle supported nanoscale oxynitrides can be produced by physically admixing nanoscale oxynitrides with iron oxide particles such as nanoscale iron oxide particles either in the presence or absence of a liquid.

In general, nanoscale oxynitrides and a support can be combined in any suitable ratio to give a desired loading of the nanoscale oxynitrides on the support. Nanoscale oxynitrides and support particles can be combined, for example, to produce from about 0.1 to 25% wt. %, e.g., at least 2 wt. %, at least 5 wt. %, at least 10 wt. % or at least 15 wt. % of the nanoscale oxynitrides on the support particles.

Supported or unsupported nanoscale oxynitrides can be distributed either homogeneously or inhomogeneously along the cigarette paper and/or throughout the tobacco cut filler or cigarette filter material of a cigarette. For example, the nanoscale oxynitrides can be incorporated along the entire length of a tobacco rod or the nanoscale oxynitrides can be located at discrete locations along the length of a tobacco rod. By providing the nanoscale oxynitrides along the cigarette paper and/or throughout the tobacco cut filler or cigarette filter material, it is possible to reduce the amount of carbon monoxide and/or nitric oxide drawn through the cigarette, and particularly in both the combustion region and in the pyrolysis zone. The nanoscale oxynitrides can be incorporated into the filter material used to form a cigarette filter. The nanoscale oxynitrides are capable of adsorbing both carbon monoxide and nitric oxide and are capable of acting as an oxidant for the conversion of carbon monoxide to carbon dioxide and/or as a reducing agent for the conversion of nitric oxide to nitrogen. The nanoscale oxynitrides can catalyze the conversion of carbon monoxide to carbon dioxide and the conversion of nitric oxide to nitrogen in either the presence or absence of an external source of oxygen.

The nanoscale oxynitrides, as described above, may be provided along the length of a tobacco rod by distributing the oxynitrides on, or incorporating them into loose cut filler tobacco using any suitable method. The oxynitrides may also be added to the cut filler tobacco stock supplied to a cigarette making machine or added to a tobacco column prior to wrapping cigarette paper around the tobacco column.

The supported or unsupported nanoscale oxynitrides may be provided in the form of a dry powder, as a dispersion in a liquid or as a paste. Supported or unsupported nanoscale oxynitrides in the form of a dry powder can be dusted on or combined with the cut filler tobacco, cigarette paper or filter material. For example, nanoscale particles and/or clusters of an oxynitride can be added to the paper stock of a cigarette paper making machine. Nanoscale oxynitrides can be incorporated into cigarette paper and/or into the raw materials used to make cigarette paper. The nanoscale oxynitrides may be present in the form of a dispersion and sprayed on the cut filler tobacco, cigarette paper and/or cigarette filter material. The tobacco cut filler, cigarette paper or cigarette filter material may be rinsed or dip-coated with a liquid containing the nanoscale oxynitride particles and/or clusters.

The amount of the nanoscale oxynitrides incorporated into a smoking article can be selected such that the amount of carbon monoxide and/or nitric oxide in mainstream smoke is reduced during smoking of a cigarette.

According to an embodiment, supported or unsupported nanoscale oxynitrides can be prepared and then incorporated into a component of a smoking article. According to a further embodiment, a method is provided for forming and depositing nanoscale oxynitrides directly on smoking article components such as tobacco cut filler, cigarette paper and cigarette filter materials.

A preferred method of forming nanoscale oxynitrides is physical vapor deposition (PVD). Physical vapor deposition can be used to form unsupported or supported nanoscale oxynitrides. As a non-limiting example, nanoscale oxynitride particles and oxynitride clusters can be formed by PVD, optionally combined with a support, and then incorporated in and/or on a smoking article component. As a further example, supported nanoscale oxynitrides can be formed by PVD and then incorporated in and/or on a smoking article component. According to an embodiment, supported or unsupported nanoscale oxynitrides can be formed and deposited in situ directly on a smoking article component by physical vapor deposition. The method comprises the steps of (i) supporting the component in a chamber having a target; (ii) bombarding the target with energetic ions to form nanoscale oxynitrides; and (iii) depositing the nanoscale oxynitrides on a surface of the component in order to incorporate the nanoscale oxynitrides in and/or on the component.

Physical vapor deposition includes sputter deposition and laser ablation of a target material. With PVD processes, material from a source (or target) is removed from the target by physical erosion by ion bombardment and deposited on a surface of a substrate. The target is formed of (or coated with) a consumable material to be removed and deposited, i.e., target material. The target material may be any suitable precursor material with a preferred form being solid or powder materials composed of pure materials or a mixture of materials. Such materials are preferably solids at room temperature and/or not susceptible to chemical degradation such as oxidation in air.

Sputtering is conventionally implemented by creating a glow discharge plasma over the surface of the target material in a controlled pressure gas atmosphere. Energetic ions from the sputtering gas, usually a chemically inert noble gas such as argon, are accelerated by an electric field to bombard and eject atoms from the surface of the target material. By energetic ions is meant ions having sufficient energy to cause sputtering of the target material. The amount of energy required will vary depending on process variables such as the temperature of the target material, the pressure of the atmosphere surrounding the target material, and material properties such as the thermal and optical properties of the target material.

If the density of the ejected atoms is sufficiently low, and their relative velocities sufficiently high, atoms from the target material travel through the gas until they impact the surface of the substrate where they can coalesce into nanoscale oxynitride particles and/or oxynitride clusters. If the density of the ejected atoms is sufficiently high, and their relative velocities sufficiently small, individual atoms from the target can aggregate in the gas phase into nanoscale oxynitrides (i.e., particles and/or clusters), which can then deposit on the substrate.

Without wishing to be bound by theory, at a sputtering pressure lower than about $10^{-4}$ Torr the mean free path of sputtered species is sufficiently long that sputter species arrive at the substrate without undergoing many gas phase collisions. Thus, at lower pressures, sputtered material can deposit on the substrate as individual species, which may diffuse and coalesce with each other to form nanoscale oxynitrides after alighting on the substrate surface. At a higher pressures, such as pressures above about $10^{-4}$ Torr, the collision frequency in the gas phase of sputtered species is significantly higher and nucleation and growth of the sputtered species to form nanoscale oxynitrides can occur in the gas phase before alighting on the substrate surface. Thus, at higher pressures, sputtered material can form nanoscale oxynitride particles and/or clusters in the gas phase, which can deposit on the substrate as discrete nanoscale oxynitrides. Sputtered species, which can form a vapor, can be cooled via interaction with gases present within the chamber. Nanoscale oxynitride particles and clusters form and can grow while losing heat to the surrounding gas and the walls of the chamber.

There are several different types of apparatus that can be used to generate a glow discharge plasma for sputtering. In a DC diode system, there are two electrodes. A positively charged anode supports the substrate and a negatively charged cathode comprises the target material. In the DC diode system, sputtering of the target is achieved by applying a DC potential across the two electrodes.

In a radio-frequency (RF) sputtering system, an AC voltage (rather than a DC voltage) is applied to the electrodes. Advantageously, an RF sputtering system can be used to sputter materials that form an insulating layer such as an insulating native oxide. In both DC and RF sputtering, most secondary electrons emitted from the target do not cause ionization events with the sputter gas but instead are collected at the anode. Because many electrons pass through the discharge region without creating ions, the sputtering rate of the target is lower than if more electrons were involved in ionizing collisions.

One known way to improve the efficiency of glow discharge sputtering is to use magnetic fields to confine electrons to the glow region in the vicinity of the cathode/target surface. This process is termed magnetron sputtering. The addition of such magnetic fields increases the rate of ionization. In magnetron sputtering systems, deposition rates greater than those achieved with DC and RF sputtering systems can be achieved by using magnetic fields to confine the electrons near the target surface.

Figure 2:
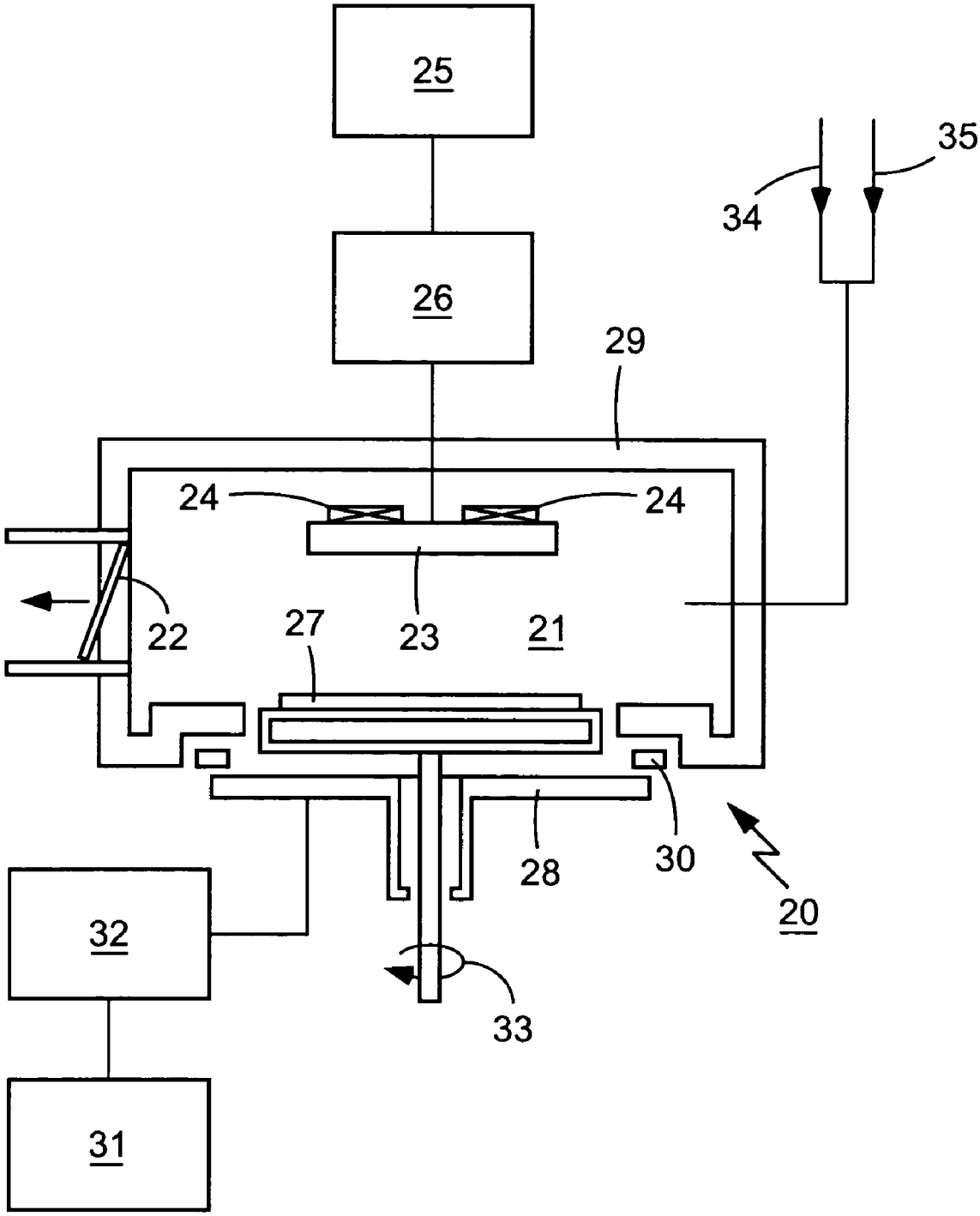
FIG. 2 is an illustration of a sputter deposition apparatus.

A method of forming and depositing nanoscale oxynitrides via sputtering is provided in conjunction with the exemplary sputtering apparatus depicted in FIG. 2. Apparatus 20 includes a sputtering chamber 21 having an optional throttle valve 22 that separates the chamber 21 from an optional vacuum pump (not shown). A pressed powder target 23 such as an iron target, an iron oxide target or an iron oxynitride target is mounted in chamber 21. Optional magnets 24 are located on the backside of target 23 to enhance plasma density during sputtering. The sputtering target 23 is electrically isolated from the housing 29 and electrically connected to a RF power supply 25 through an impedance matching device 26. A substrate 27 can be mounted on a substrate holder 28, which is electrically isolated from the housing 29 by a dielectric spacer 30. The housing 29 is maintained at a selected temperature such as room temperature. The substrate holder 28 can be RF biased for plasma cleaning using an RF power supply 31 connected through an impedance matching device 32. The substrate holder 28 can also be provided with rotation capability 33.

Referring still to FIG. 2, the reactor chamber 21 contains conduits 34 and 35 for introducing various gases. For example, argon could be introduced through conduit 34 and nitrogen through conduit 35. Gases are introduced into the chamber by first passing them through separate flow controllers to provide a total pressure of argon and nitrogen in the chamber of greater than about $10^{-4}$ Torr. The partial pressure of the gases introduced to the chamber can be controlled by evacuating the chamber (e.g., evacuating the chamber to a base pressure of less than about $10^{-3}$ Torr) before introducing the gases to the chamber.

In order to obtain a reactive sputtering plasma of the gas mixture, an RF power density of from about 0.01 to 10 W/cm$^2$ can be applied to the target 23 throughout the deposition process. Pressure in the chamber during physical vapor deposition can be between about $10^4$ Torr to 760 Torr. The substrate temperature can be between about −196° C. and 100° C. A temperature gradient can be maintained between the target and the substrate during the deposition by flowing a cooling liquid such as chilled water or liquid nitrogen through the substrate support. In order to reduce condensation on the sidewalls of the chamber, the sidewalls can be heated, e.g., resistance heater wires surrounding the outer periphery of the sidewall can be used to heat the sidewall.

Nanoscale oxynitrides can be formed and collected on a substrate 27, and then incorporated into a smoking article component such as tobacco cut filler, cigarette paper or tobacco filter material as described above. Alternatively, the substrate can comprise a component of a smoking article and the nanoscale oxynitrides can be formed and simultaneously incorporated in and/or on the smoking article component.

As is well known in the art, energetic ions can also be provided in the form of an ion beam from an accelerator, ion separator or an ion gun. An ion beam may comprise inert gas ions such as neon, argon, krypton or xenon. Argon is preferred because it can provide a good sputter yield and is relatively inexpensive. The energy of the bombarding inert gas ion beam can be varied, but should be chosen to provide a sufficient sputtering yield. The ion beam can be scanned across the surface of the target material in order to improve the uniformity of target wear.

The introduction of reactive gases into the chamber during the deposition process allows material sputtered or ablated from the target to combine with such gases to obtain nitrided transition metal oxide nanoscale particles and/or clusters. Thus, in reactive PVD the sputtering gas includes a small proportion of a reactive gas such as a nitriding gas and/or an oxidizing gas. Exemplary nitriding gases include $N_2$, $NH_3$, forming gas and mixtures thereof, and exemplary oxidizing gases include CO, $CO_2$, NO, $O_2$, $H_2O$ or mixtures thereof. The reactive gas can react with the atoms of the target material to form nitrided transition metal oxide nanoscale particles and/or clusters. For example, iron oxynitride nanoscale particles and clusters can be deposited by sputtering an iron oxide target in the presence of nitrogen or by sputtering an iron target in the presence of oxygen and nitrogen. Also, nanoscale oxynitrides can be deposited on a substrate via the sputtering of the corresponding oxynitride target. For example, nanoscale iron oxynitride may be deposited by sputtering an iron oxynitride target.

The structure and composition of the nanoscale oxynitrides can be controlled using physical vapor deposition. The particle size, ground state geometry and metal to oxygen and nitrogen ratios can be controlled by varying, for example, the deposition pressure, ion energy and substrate temperature.

According to an embodiment, nanoscale oxynitrides and support particles are formed simultaneously to produce supported nanoscale oxynitrides. Supported nanoscale oxynitrides can be formed by sputtering or ablating a mixed or composite target. Such a target comprises at least first and second transition metal elements. A suitable target can comprise, for example, iron oxynitride and copper oxynitride in the form of a pressed pellet, which can be sputtered or ablated to form iron oxynitride nanoscale particles and/or clusters supported on support particles comprising copper oxide.

A preferred example of PVD is laser ablation. An apparatus for ablative processing includes a chamber in which a target material is placed. Typically, the chamber includes two horizontal metal plates separated by an insulating sidewall. An external energy source, such as a pulsed excimer laser, enters the chamber through a window, preferably quartz, and interacts with the target. Alternatively, the energy source can be internal, i.e., positioned inside the chamber.

Preferably a temperature gradient is maintained between the top and bottom plates, which can create a steady convection current that can be enhanced by using a heavy gas such as argon and/or by using above atmospheric pressure conditions in the chamber (e.g., above about $1\times10^3$ Torr). The steady convection current can be achieved in two ways; either the bottom plate is cooled such as by circulating liquid nitrogen and the top plate is kept at a higher temperature (e.g., room temperature) or the top plate is heated such as by circulating heating fluid and the bottom plate is kept at a lower temperature (e.g., room temperature). In either case, the bottom plate is kept at a temperature significantly lower than the top plate, which makes the bottom plate the condensation or deposition plate. Preferably a temperature gradient of at least 20° C., more preferably at least 50° C., is maintained between the top plate and the bottom during the deposition. Convection within the chamber may be enhanced by increasing the temperature gradient or by using a heavier carrier gas (e.g., argon as compared to helium). Details of a suitable chamber can be found in The Journal of Chemical Physics, Vol. 52, No. 9, May 1, 1970, pp. 4733-4748, the disclosure of which is hereby incorporated by reference.

In an ablative process, a region of the target absorbs incident energy from the energy source. This absorption and subsequent heating of the target causes target material to ablate from the surface of the target into a plume of atomic and nanometer-scale particles. Laser energy preferably vaporizes the target directly, without the target material undergoing significant liquid phase transformations. Laser vaporization produces a high-density vapor within a very short time, typically $10^{-8}$ sec, in a directional jet that allows directed deposition. The particles ejected from the target undergo Brownian motion during the gas-to-particle/cluster conversion. The ablated species, which are cooled by the carrier gas, can reach a high degree of supersaturation and can condense to form nanoscale oxynitrides. The higher the supersaturation, the smaller will be the size of the nucleus required for condensation in the gas phase. Changing the temperature gradient may enhance the supersaturation in the chamber. The ablated species can condense in the gas phase and/or after alighting on the surface of a substrate. Nanoscale particles and clusters having different stoichiometries (e.g., different metal/oxygen/nitrogen ratios) can be obtained under different ablation conditions.

As with conventional sputtering, nanoscale particles and clusters of metal oxynitrides can be prepared by laser ablation of metal, metal oxide or metal oxynitride targets into a carrier gas flow in the presence of optional oxidizing and nitriding gases. The reaction chamber is connected to a gas supply. The carrier gas can comprise an inert gas such as He, Ar or mixtures thereof. The optional oxidizer gas can comprise an oxygen-containing gas such as CO, $CO_2$, NO, $O_2$, $H_2O$ or mixtures thereof. The optional nitriding gas can comprising a nitrogen-containing gas such as $N_2$, $NH_3$, forming gas or mixtures thereof.

In an embodiment, nanoscale oxynitrides may be formed by a physical vapor deposition process such as laser ablation, collected, and incorporated into a component of a smoking article. In another embodiment, nanoscale oxynitrides may be simultaneously formed and incorporated in and/or on a component of a smoking article using a physical vapor deposition process such as laser ablation. Advantageously, ablation such as laser ablation can be performed at or above atmospheric pressure without the need for vacuum equipment. Thus, the nanoscale oxynitrides may be simultaneously formed and deposited on a component of a smoking article that is maintained at ambient temperature and atmospheric pressure during the deposition process. The smoking article material may be supported on a substrate holder or, because a laser ablation process can be carried out at atmospheric pressure, passed through the coating chamber on a moving substrate holder such as a conveyor belt operated continuously or discontinuously to incorporate the desired amount of deposited nanoscale oxynitrides in and/or on the smoking article component.

Lasers include, but are not limited to, Nd-YAG lasers, ion lasers, diode array lasers and pulsed excimer lasers. Laser energy may be provided by the second harmonic of a pulsed Nd-YAG laser at 532 nm with 15-40 mJ/pulse. In a preferred embodiment, the vapor can be generated in the chamber by pulsed laser vaporization using the second harmonic (532 nm) (optionally combined with the fundamental (1064 nm)) of a Nd-YAG laser (50-100 mJ/pulse, $10^{-8}$ second pulse). The laser beam can be scanned across the surface of the target material in order to improve the uniformity of target wear by erosion.

As discussed above, with sputtering a substrate is typically placed proximate to the cathode. With sputtering and ablative processes, the substrate is preferably placed within sputtering proximity of the target, such that it is in the path of the sputtered or ablated target atoms and the target material is deposited on the surface of the substrate.

By regulating the deposition parameters, including background gas, pressure, substrate temperature and time, it is possible to prepare cigarette components such as tobacco cut filler, cigarette paper and/or cigarette filter material that comprise a loading and distribution of supported or unsupported nanoscale oxynitrides effective to reduce the amount of carbon monoxide and/or nitric oxide in mainstream smoke.

Preferably, the amount of the nanoscale oxynitride will be a catalytically effective amount. Preferably, the nanoscale oxynitrides particles and/or clusters are incorporated in a cigarette in an amount effective to reduce the ratio in mainstream smoke of carbon monoxide to total particulate matter (e.g., tar) by at least 10% (e.g., by at least 15%, 20%, 25%, 30%, 35%, 40% or 45%), and reduce the ratio in mainstream smoke of nitric oxide to total particulate matter (e.g., tar) by at least 10% (e.g., by at least 15%, 20%, 25%, 30%, 35%, 40% or 45%). Preferably, the nanoscale oxynitrides comprise less than about 10% by weight of the smoking article component, more preferably less than about 5% by weight of the smoking article component. Preferably, the nanoscale oxynitrides comprise less than about 10% by weight of the cigarette, more preferably less than about 5% by weight of the cigarette.

When forming and depositing nanoscale oxynitrides directly on a smoking article component, the PVD process is stopped when there is still exposed surface of the smoking article component. That is, the PVD method does not build up a continuous layer but rather forms discrete nanoscale oxynitride particles and/or clusters that are distributed over the component surface. During the process, new particles and clusters can form and existing particles and clusters can grow. Advantageously, physical vapor deposition allows for dry, solvent-free, simultaneous formation and deposition of nanoscale oxynitrides under sterile conditions.

One embodiment provides tobacco cut filler, cigarette paper or cigarette filter material that comprise nanoscale oxynitrides. Any suitable tobacco mixture may be used for the cut filler. Examples of suitable types of tobacco materials include flue-cured, Burley, Maryland or Oriental tobaccos, the rare or specialty tobaccos, and blends thereof. The tobacco material can be provided in the form of tobacco lamina, processed tobacco materials such as volume expanded or puffed tobacco, processed tobacco stems such as cut-rolled or cut-puffed stems, reconstituted tobacco materials, or blends thereof. The tobacco can also include tobacco substitutes.

In cigarette manufacture, the tobacco is normally employed in the form of cut filler, i.e., in the form of shreds or strands cut into widths ranging from about 1/10 inch to about 1/20 inch or even 1/40 inch. The lengths of the strands range from between about 0.25 inches to about 3.0 inches. The cigarettes may further comprise one or more flavorants or other additives (e.g., burn additives, combustion modifying agents, coloring agents, binders, etc.) known in the art.

A further embodiment provides a cigarette comprising a tobacco rod, cigarette paper and an optional filter, wherein at least one of the tobacco rod, cigarette paper and optional filter comprise nanoscale oxynitrides. A still further embodiment relates to a method of making a cigarette, wherein the nanoscale oxynitrides are incorporated in and/or on at least one of tobacco cut filler and cigarette paper, which are provided to a cigarette making machine and formed into a cigarette. The cigarette may comprise an optional filter that comprises nanoscale oxynitrides.

Techniques for cigarette manufacture are known in the art. Any conventional or modified cigarette making technique may be used to incorporate the clusters. The resulting cigarettes can be manufactured to any known specifications using standard or modified cigarette making techniques and equipment. Typically, the cut filler composition is optionally combined with other cigarette additives, and provided to a cigarette making machine to produce a tobacco column, which is then wrapped in cigarette paper, and optionally tipped with filters. Nanoscale oxynitrides incorporated into cigarette filter material can adsorb carbon monoxide and/or nitric oxide.

Cigarettes may range from about 50 mm to about 120 mm in length. The circumference is from about 15 mm to about 30 mm in circumference, and preferably around 25 mm. The tobacco packing density is typically between the range of about 100 mg/cm$^3$ to about 300 mg/cm$^3$, and preferably 150 mg/cm$^3$ to about 275 mg/cm$^3$.

Provided also are methods for incorporating nanoscale oxynitrides in and/or on a component of a smoking article. In one embodiment the component is supported in a PVD chamber and a suitable target is bombarded to form nanoscale oxynitrides that are incorporated in and/or on the smoking article component. In a further embodiment, nanoscale oxynitrides are sprayed, dusted and/or mixed with a component of a smoking article.

Yet another embodiment provides a method of smoking the cigarette described above, which involves lighting the cigarette to form smoke and drawing the smoke through the cigarette, wherein during the smoking of the cigarette, the nanoscale oxynitrides adsorb carbon dioxide and/or convert carbon monoxide to carbon dioxide and adsorb nitric oxide and/or convert nitric oxide to nitrogen.

While various embodiments have been described, it is to be understood that variations and modifications may be resorted to as will be apparent to those skilled in the art. Such variations and modifications are to be considered within the purview and scope of the claims appended hereto.

All of the above-mentioned references are herein incorporated by reference in their entirety to the same extent as if each individual reference was specifically and individually indicated to be incorporated herein by reference in its entirety.

What is claimed is:

1. A component of a smoking article comprising nitrided transition metal oxide nanoscale particles and/or nitrided transition metal oxide clusters, wherein the component is selected from the group consisting of tobacco cut filler, cigarette paper and cigarette filter material, and wherein the nanoscale particles and/or clusters comprise iron oxynitride.

2. The smoking article component of claim 1, wherein the nanoscale particles and/or clusters consist of iron oxynitride.

3. The smoking article component of claim 1, wherein the nanoscale particles and/or clusters are capable of catalyzing and/or oxidizing carbon monoxide to carbon dioxide and are capable of catalyzing and/or reducing nitric oxide to nitrogen.

4. The smoking article component of claim 1, wherein the nanoscale particles and/or clusters are capable of converting carbon monoxide to carbon dioxide by donating oxygen atoms to the carbon monoxide and simultaneously converting nitric oxide to nitrogen, wherein the nanoscale particles have the general formula $Fe_2O_{3-x}N_x$ ($x<3$) and the clusters have the general formula $Fe_xO_yN_z$ ($y>x$).

5. The smoking article component of claim 1, wherein the nanoscale particles and/or clusters are capable of converting carbon monoxide to carbon dioxide in the presence of an external source of oxygen and simultaneously converting nitric oxide to nitrogen, wherein the nanoscale particles have the general formula $Fe_3O_{4-x}N_x$ ($x<4$) and the clusters have the general formula $Fe_xO_yN_z$ ($y \leqq x$).

6. The smoking article component of claim 1, wherein the nanoscale particles and/or clusters are present in an amount effective to reduce the ratio in mainstream smoke of carbon monoxide and/or nitric oxide to total particulate matter by at least about 10%.

7. The smoking article component of claim 1, wherein the nanoscale particles have a mean particle size of less than about 500 nm.

8. The smoking article component of claim 1, wherein the clusters have a mean particle size of less than about 2 nm or less than about 1 nm.

9. The smoking article component of claim 1, wherein the clusters comprise fewer than about 2,500 atoms.

10. The smoking article component of claim 1, wherein the nanoscale particles and/or clusters are charge neutral.

11. The smoking article component of claim 1, wherein the nanoscale particles and/or clusters are supported on support particles.

12. The smoking article component of claim 11, wherein the support particles are selected from the group consisting of silica gel beads, activated carbon, molecular sieves, magnesia, alumina, silica, titania, zirconia, iron oxide, cobalt oxide, nickel oxide, copper oxide, yttria optionally doped with zirconium, manganese oxide optionally doped with palladium, ceria and mixtures thereof.

13. The smoking article component of claim 11, wherein the support particles have a mean particle size of less than about 500 nm.

14. The smoking article component of claim 11, wherein the nanoscale particles and/or clusters comprise less than about 10 wt. % of the support particles.

15. The smoking article component of claim 1, wherein the nanoscale particles and/or clusters comprise less than about 10 wt. % of the component.

* * * * *